US008275571B2

(12) United States Patent
McNelis

(10) Patent No.: US 8,275,571 B2
(45) Date of Patent: Sep. 25, 2012

(54) METHOD AND SYSTEM FOR CORRELATING WEAPON FIRING EVENTS WITH SCORING EVENTS

(75) Inventor: Niall B. McNelis, Sparks Glencoe, MD (US)

(73) Assignee: AAI Corporation, Hunt Valley, MD (US)

( * ) Notice: Subject to any disclaimer, the term of this patent is extended or adjusted under 35 U.S.C. 154(b) by 391 days.

(21) Appl. No.: 12/487,545

(22) Filed: Jun. 18, 2009

(65) Prior Publication Data

US 2010/0324863 A1 Dec. 23, 2010

(51) Int. Cl.

| | |
|---|---|
| ***G01C 9/00*** | (2006.01) |
| ***G01D 21/00*** | (2006.01) |
| ***F41G 3/26*** | (2006.01) |
| ***F41G 3/00*** | (2006.01) |

(52) U.S. Cl. ..... 702/151; 702/86; 434/19; 434/21

(58) Field of Classification Search ..... 356/5.05, 356/141.1; 463/5; 273/371, 372, 348, 392, 273/406; 702/107, 86, 150, 151, 152, 153, 702/155–158; 434/21, 22, 11, 16, 19, 14
See application file for complete search history.

(56) References Cited

U.S. PATENT DOCUMENTS

| | | | | |
|---|---|---|---|---|
| 5,988,645 | A | 11/1999 | Downing | |
| 6,109,614 | A | 8/2000 | Ciarcia | |
| 6,415,211 | B1 | 7/2002 | Kotlow | |
| 6,484,115 | B1 * | 11/2002 | Freymond et al. | 702/104 |
| 6,549,872 | B2 | 4/2003 | Bollweg et al. | |
| 6,669,477 | B2 | 12/2003 | Hulet | |
| 7,329,127 | B2 * | 2/2008 | Kendir et al. | 434/21 |
| 2003/0082502 | A1 | 5/2003 | Stender et al. | |
| 2003/0136900 | A1 | 7/2003 | Shechter et al. | |
| 2004/0200109 | A1 | 10/2004 | Vasquez | |
| 2005/0116421 | A1 | 6/2005 | Kuosa | |
| 2006/0050610 | A1 | 3/2006 | Harvey et al. | |
| 2007/0035528 | A1 | 2/2007 | Hodge | |
| 2007/0067138 | A1 | 3/2007 | Rabin et al. | |
| 2008/0020354 | A1 | 1/2008 | Goree et al. | |
| 2008/0167835 | A1 | 7/2008 | Zank et al. | |
| 2008/0289485 | A1 | 11/2008 | Quinn et al. | |
| 2009/0123894 | A1 * | 5/2009 | Svane et al. | 434/20 |

OTHER PUBLICATIONS

International Search Report and Written Opinion issue in PCT/US2010/39044, dated Mar. 11, 2011.

(Continued)

*Primary Examiner* — Mohamed Charioui
*Assistant Examiner* — Ricky Ngon
(74) *Attorney, Agent, or Firm* — Venable LLP; Jeffri A. Kaminski

(57) ABSTRACT

An exemplary embodiment, the present invention sets forth a method for correlating at least one weapon firing event to at least one scoring event. The method comprising: receiving information relating to a first scoring event; receiving information relating to a first weapon firing event; calculating an angle between a reference line, extending from location of the first weapon event to the location of the first scoring event, and the reference direction at the first computing device; comparing the time of the first scoring event to the time of the weapon firing event at the first computing device; comparing the angle of incidence for the projectile to the calculated angle at the first computing device; and identifying whether the weapon firing event and the scoring event are an unambiguous, one-to-one pairings at the first computing device.

8 Claims, 7 Drawing Sheets

OTHER PUBLICATIONS

International Search Report and Written Opinion issued in PCT/US10/39052, dated Mar. 11, 2011.

International Search Report and Written Opinion Issued in PCT/US2010/39049, dated Mar. 4, 2011.

International Preliminary Report on Patentability and Written Opinion of the International Search Authority, International Application No. PCT/US10/39044; dated Jan. 5, 2012.

International Preliminary Report on Patentability and Written Opinion of the International Search Authority, International Application No. PCT/US10/39049; dated Jan. 5, 2012.

International Preliminary Report on Patentability and Written Opinion of the International Search Authority, International Application No. PCT/US10/39052; dated Jan. 5, 2012.

* cited by examiner

METHOD AND SYSTEM FOR CORRELATING WEAPON FIRING EVENTS WITH SCORING EVENTS

CROSS-REFERENCE TO RELATED APPLICATIONS

The present application is related to co-pending U.S. patent application entitled "Apparatus, System, Method, and Computer Program Product for Detecting Projectiles," Ser. No. 12/487,542, and co-pending U.S. patent application entitled "Apparatus, System, Method, and Computer Program Product for Registering the Time and Location of Weapon Firings," Ser. No. 12/487,539, the contents of which are incorporated herein by reference in their entirety.

BACKGROUND

When new military weapons are evaluated, it may be advantageous to evaluate the weapons under actual combat conditions. Thus soldiers and marines may be run through actual platoon attack scenarios with live fire. However, to determine the effectiveness of the weapon, or the skill of the user of the weapon, each bullet fired must be correlated with the impact point of that bullet. This requires that each bullet fired be linked to the weapon that fired it, and that the time and location of the firing be known. Marking bullets, for example, through coloration, may allow bullets to be linked back to the respective weapons of the bullets, but provides no information as to where and when the bullet was fired. Bullets may also be lost, especially if the bullets miss the bullets' target, or if the bullets are destroyed, if the bullets hit a target.

SUMMARY

An exemplary embodiment, the present invention sets forth a method for correlating at least one weapon firing event to at least one scoring event. The method comprising: (a) receiving, for a first scoring event, a time at which the first scoring event occurred, a location where the scoring event occurred, a direction of a reference direction, and an angle of incidence for a projectile associated with the scoring event with respect to the reference direction at a first computing device; (b) receiving, for a first weapon firing event, a time at which the first weapon firing event occurred, and a location where the first weapon firing event occurred at the first computing device; (c) calculating an angle between a reference line, extending from location of the first weapon event to the location of the first scoring event, and the reference direction at the first computing device; (d) comparing the time of the first scoring event to the time of the weapon firing event at the first computing device; (e) comparing the angle of incidence for the projectile to the calculated angle at the first computing device; and (f) identifying, based on the (d.) and (e.), whether the weapon firing event and the scoring event are an unambiguous, one-to-one pairings at the first computing device.

According to an exemplary embodiment, the method may further include calculating a time-of-flight window for a projectile associated with the first weapon firing event; adding the calculated time-of-flight window to the time of the first weapon firing; and step (d) may further include comparing the time of the first scoring event to the time of the weapon firing event at the first computing device.

According to an exemplary embodiment, the time at which each scoring event occurred and the time at which each weapon firing event occurred are determined in relation to a common measurement of time.

According to an exemplary embodiment, the present invention sets forth a method for correlating weapon firing events to target scoring events. The method includes (a) receiving, for a plurality of scoring events, a time at which each scoring event occurred, a location of each scoring area when each scoring event occurred, a direction of a reference direction, and an angle of incidence for each projectile associate with each scoring event with respect to the reference direction at a first computing device; (b) receiving, for a plurality of weapon firing events, a time at which the each weapon firing event occurred, and a location where each weapon firing events occurred at the first computing device; (c) creating a plurality of reference lines for each scoring event and each weapon firing event combination, wherein each reference line extends from the location of each weapon firing event to the location of each scoring event; (d) calculating a plurality of angles between the plurality of reference lines and the reference direction at the first computing device; (e) comparing the time of each scoring event to the time of each weapon firing event at the first computing device; (f) comparing the angle of incidence for the projectile of each scoring event to each of the calculated angles at the first computing device; (g) identifying, based on the (d.) and (e.), each unambiguous, one-to-one pairings between scoring events and weapon firing events at the first computing device; and (h) storing each unambiguous, one-to-one pairing identified in (g).

According to an exemplary embodiment, the method may further comprise (i) removing each unambiguous, one-to-one pairing identified in (g) from further consideration; (j) comparing the time of each remaining scoring event to the time of each remaining weapon firing event at the first computing device; (k) comparing the angle of incidence of the projectile of each remaining scoring event to each of the calculated angles at the first computing device; and (l) identifying, based on the (j.) and (k.), unambiguous, one-to-one pairings between scoring events and weapon firing events, at the first computing device.

According to an exemplary embodiment, (c) may further comprise calculating a time-of-flight window for a projectile associated with each weapon firing event; adding each calculated time-of-flight window to the time of each weapon firing. In addition, (d) further comprises: comparing the time of each scoring event to the time of each weapon firing event at the first computing device.

According to an exemplary embodiment, the time at which each scoring event occurred and the time at which each weapon firing event occurred are determined in relation to a common measurement of time.

An exemplary embodiment of the present invention sets forth a system for correlating weapon firing events to target scoring events comprising: a computing device; a target device for detecting a plurality of scoring events and, for each detected scoring, event, determining a time at which each scoring event occurred, a location of each scoring area when each scoring event occurred, a direction of a reference direction, an angle of incidence for each projectile associate with each scoring event with respect to the reference direction, and outputting said determinations to a computing device; and a weapon device for detecting a plurality of weapon firing events and, for each detected weapon firing events, determining a time at which the each weapon firing event occurred, a location where each weapon firing events occurred at the first computing device, and outputting said determinations to the computing device, wherein said computing device: creates a plurality of reference lines for each scoring event and each weapon firing event combination, wherein each reference line extends from the location of each weapon firing event to the location of each scoring event; calculates a plurality of angles between the plurality of reference lines and the reference direction at the first computing device; compares the time of each scoring event to the time of each weapon firing event at the first computing device; compares the angle of incidence of the projectile of each scoring event to each of the calculated angles at the first computing device; and identifies, based on the (d.) and (e.), each unambiguous, one-to-one pairings between scoring events and weapon firing events at the first computing device; and stores each unambiguous, one-to-one pairing identified in (g).

Further features of the embodiments, as well as the structure and operation of various embodiments, are described in detail below with reference to the accompanying drawings.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The left most digits in the corresponding reference number indicate the drawing in which an element first appears.

DETAILED DESCRIPTION OF THE EMBODIMENTS

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a similar manner to accomplish a similar purpose. The examples and embodiments described herein are non-limiting examples.

Figure 1:
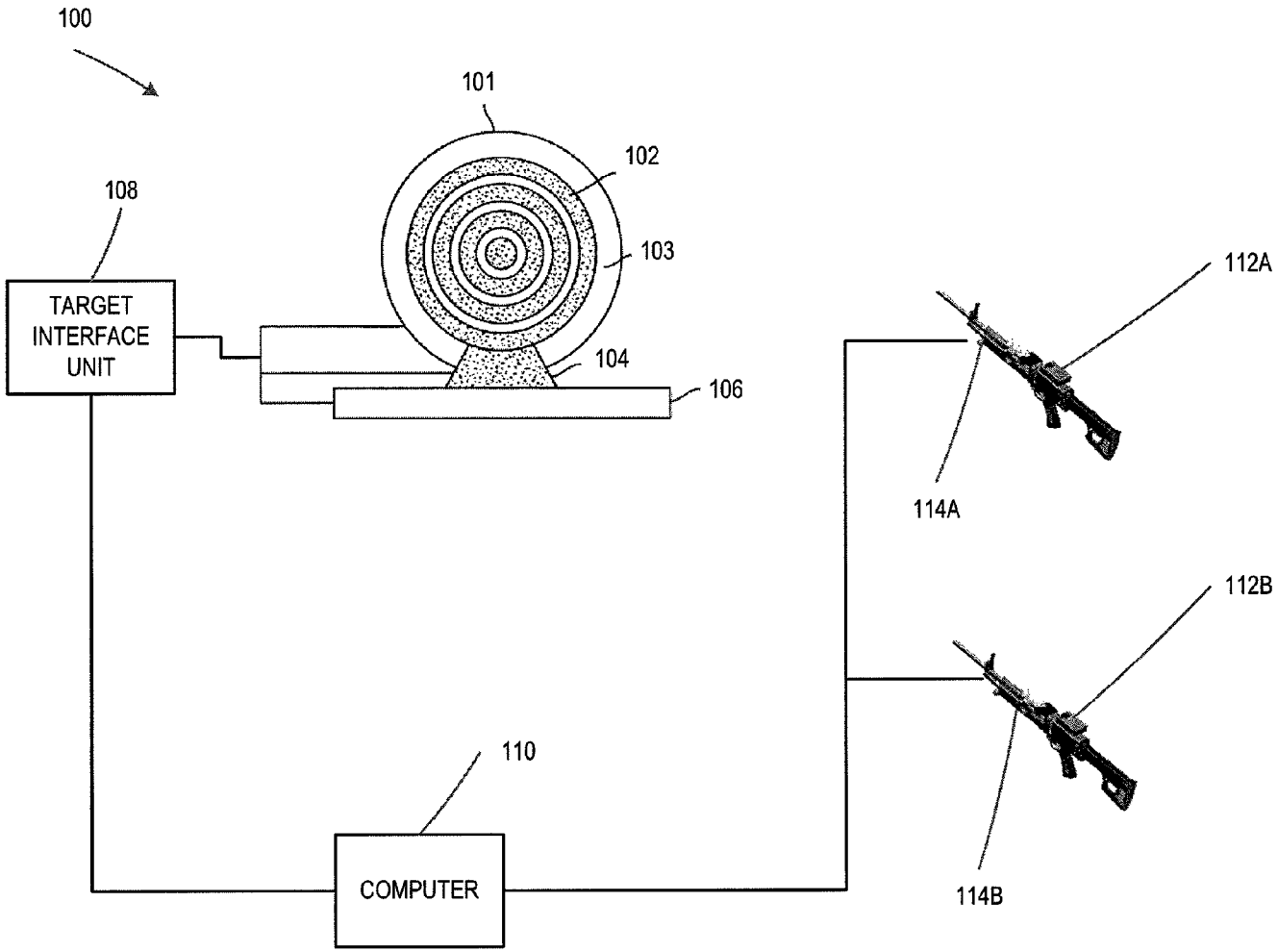
FIG. 1 depicts an exemplary system for use with an exemplary method of correlating weapon firing events, from multiple weapons, with scoring events.

FIG. 1 depicts an exemplary system for use with an exemplary method of correlating weapon firing events, from multiple weapons, with scoring events. The exemplary system 100 may be comprised of, for example, but not limited to, a scoring area 101, two (or more) weapons 114A, 114B, two (or more) apparatuses for registering the time and location of weapon firings (hereinafter referred to as 'player packs') 112A and 112B for registering the time and location of a weapon firing (mounted to the weapons 114A and 114B, respectively), a target interface unit (TIU) 108, and a lifter 104.

Scoring area 101 may include, e.g., but is not limited to, a target 102 and a suppression zone 103. An exemplary scoring area is described in the related application entitled "Apparatus, System, Method, and Computer Program Product for Detecting Projectiles," Ser. No. 12/487,542, the contents of which are incorporated herein by reference in their entirety. In an exemplary embodiment, a scoring event may refer to the passage of a projectile through the scoring area 101.

Player packs 112A, 112B, which is described in related application entitled "Apparatus, System, Method, and Computer Program Product for Registering the Time and Location of Weapon Firings," Ser. No. 12/487,539, the contents of which are incorporated herein by reference in their entirety, may be capable of unambiguously identifying a weapon firing event and recording data related to that event. Data related to a weapon firing event may be, e.g., but not is limited to, the time the event occurred and the position where the event occurred.

The TIU 108, which is described in related application entitled "Apparatus, System, Method, and Computer Program Product for Detecting Projectiles," Ser. No. 12/487,542, the contents of which are incorporated herein by reference in their entirety, may be capable of detecting scoring events that occur in the scoring area 101 and recording data related to those events. Data related to a scoring event may be, e.g., but is not limited to, the time at which each scoring event occurred, where the projectile passed through the scoring area 101, whether the target 102 was exposed when each scoring event occurred, the location of the target 102 when the scoring event occurred, the orientation of the scoring area 101 with respect to a reference direction (such as, e.g., true north), and/or the angle of incidence of the scoring event (e.g. the angle of incidence of the projectile which caused the scoring event) with respect to the reference direction.

Furthermore, as was disclosed in related applications discussed above, the contents of which are incorporated herein by reference in their entirety, the determination of time at which each scoring event occurred and the time at which each weapon firing event took place may be synchronized with a common source of time, such as, e.g., but not limited to, an atomic clock or a GPS signal. In an exemplary embodiment, player packs 112A, 112B and the TIU 108 may have internal clocks which have been synchronized to a common source of time. In another exemplary embodiment, player packs 112A, 112B and the TIU 108 may continuously and/or periodically receive the time from a common source, such as a global positioning system (GPS) signal.

The player packs 112A, 112B and/or the TIU 108 may be able to exchange, e.g., on a delay, or in real-time, recorded data with one another or with computer 110, TIU 108, sensor 106, etc. The player packs 112A and 112B, TIU 108, and computer 110 may be coupled to one another wirelessly or by wires while information is exchanged.

The computer 110 may be able to execute a method of correlating weapon firing events, recorded by player packs 112A and 112B, with scoring events, recorded by the TIU 108, which occur in the scoring area 101. The computer 110 may be comprised of hardware, software, or a combination of hardware and software, and communications networking hardware and software.

Figure 2:
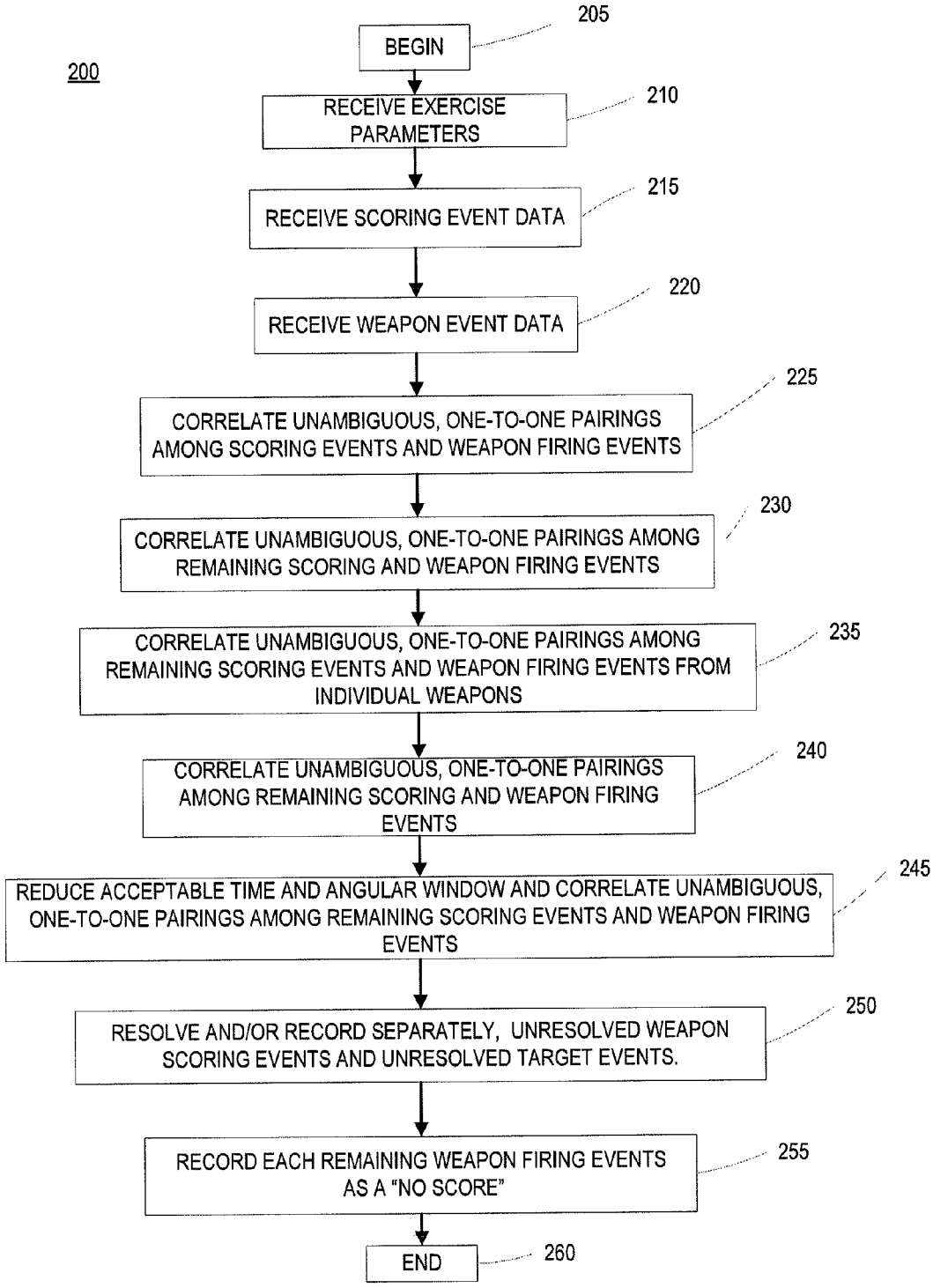
FIG. 2 depicts an exemplary flowchart for an exemplary method of correlating weapon firing events, from multiple weapons, with scoring events.

FIG. 2 depicts an exemplary flowchart 200 for an exemplary method of correlating weapon firing events, from multiple weapons, with scoring events. The exemplary method 200 begins in block 205 and may proceed immediately to block 210.

In block 210, exercise parameters may be received. Exercise parameters may refer to characteristics of an exemplary exercise which may be monitored by at least one player pack 112A, 112B and at least one TIU 108. Exercise parameters may improve the accuracy or efficiency of the exemplary method of correlating weapon firing events, from multiple weapons, with scoring events.

Exercise parameters may refer to time of flight (TOF) tables for the type(s) of weapon(s)/monition(s) that will be used in the exercise, the number of weapons 114A, 114B used in the exercise, the number of targets 102 used in the exercise, the dimensions or size of the area where the exercise will be conducted, anticipated GPS location calculation errors (including WAAS and non-WAAS GPS errors), the upper and lower limits of an average weapon burst count, the average number of burst shots that result in "No Scores," the average number of single shots which result in no-scores, and applicable TIU 108 lock-out times. From 210, flow diagram 200 may continue with 215.

In block 215, scoring event data from the TIU 108 may be received. Scoring event data accessed from the TIU 108 may include, e.g., but is not limited to, the time at which each scoring event occurred due to the impact of a projectile, whether the target 102 was in an exposed position when the scoring event occurred, the location of the target 102 when the scoring event occurred, the orientation of the scoring area 101 with respect to a reference direction, and/or the angle of incidence of the projectile with respect to the reference direction. The scoring event data may be sorted by scoring area 101 (in the event more than one scoring area 101 is in use) and the time at which the scoring event occurred.

In an exemplary embodiment, the computer 110 may receive data from the TIU 108, e.g., in real-time, at set intervals, and/or upon completion of an event, such as a training exercise. From 215, flow diagram 200 may continue with 220.

In block 220, weapon firing event data from the player packs 112A, 112B may be received. Weapon firing event data accessed from the player packs 112A, 112B may include, e.g., but is not limited to, the time at which each weapon firing event took place, the location of the weapon 114A, 114B during each firing event, the data from the pressure sensor within the player pack 112A, 112B, and the data from the accelerometer that caused the player pack 112A, 112B to determine that a firing took place. The weapon firing data may be sorted by weapon 114A, 114B (in the event more than one weapon firing event occurred) and the time at which the weapon firing event occurred.

In an exemplary embodiment, the computer 110 may receive data from the TIU 108 in real-time, at set intervals, and/or upon completion of an event, such as a training exercise. From 220, flow diagram 200 may continue with 225.

In block 225, a correlation of unambiguous, one-to-one pairings between scoring events and weapon firing events may occur. Once an unambiguous, one-to-one match has been identified between an exemplary scoring event and an exemplary weapon-firing event, the scoring event and weapon firing event information may be marked as resolved. For example, exemplary weapon-firing event information may be associated with the exemplary scoring event and exemplary scoring event information may be associated with exemplary weapon firing event information. Both the exemplary weapon-firing event and the exemplary scoring event may be marked as a resolved pair. Once a resolved pair is established, it may be removed from further consideration in blocks 230 through 255. An exemplary embodiment of block 225 is described further below with reference to FIG. 3. From 225, flow diagram 200 may continue with 230.

In block 230, one or more additional correlations of unambiguous, one-to-one pairings between the remaining scoring events and weapon firing events may occur. The one or more additional correlations may occur by removing all previously resolved weapon firing events and scoring events from consideration and re-running block 225.

In an exemplary embodiment of blocks 225 and 230, weapon firing event A may ambiguously match scoring events A and B in block 225. Thus, in block 225, weapon firing event A is determined to be within the time and angular windows of scoring event A and scoring event B. Thus weapon firing event A does not unambiguously match scoring event A or scoring event B. However, weapon firing event B may unambiguously match scoring event B and, therefore, be removed from consideration following block 225. Thus, when block 230 is run, weapon firing event A may now be the only weapon firing event which unambiguously matches the time and angular window of scoring event A. Thus weapon firing event A may be an unambiguous match with scoring event A.

In block 230, the time window and angular window may increase, decreased or remain unchanged from one correlation to the next. The time window may be increased/decreased, for example, by assuming the TOF for an exemplary projectile is longer/shorter than originally calculated. The angular window may be increased/decreased, for example, by assuming the location determination of the weapon firing event and/or scoring event is less/more accurate than originally calculated. From 230, flow diagram 200 may continue with 235.

In block 235, a correlation of unambiguous, one-to-one pairings among remaining scoring events and weapon firing events from individual weapons may occur. A detailed exemplary embodiment of 235 is described further below with reference to FIG. 4. From 235, flow diagram 200 may continue with 240.

In block 240, one or more additional correlations of unambiguous, one-to-one pairings between the remaining scoring events and weapon firing events may occur. The third correlation may occur by removing all previously resolved weapon firing events and scoring events from consideration and performing the method of block 225. In an exemplary embodiment, the time window and angular window may increase, decreased or remain unchanged from one correlation to the next. The time window may be increased/decreased, for example, by assuming the TOF for an exemplary projectile is longer/shorter than originally calculated. The angular window may be increased/decreased, for example, by assuming the location determination of the weapon firing event and/or scoring event is less/more accurate than originally calculated. From 240, flow diagram 200 may continue with 245.

In block 245, the computer 110 may correlate unresolved scoring event data with unresolved weapon firing event data and identify additional unambiguous, one-to-one pairings by repeating block 225 with a reduced the time and angular window. From 245, flow diagram 200 may continue with 250.

In block 250, the process may identify two or more unresolved weapon firing events which are within a given time window and angular window associated with two or more unresolved scoring events. In an exemplary embodiment, these events may be resolved and/or recorded separately as unresolved events. From 250, flow diagram 200 may continue with 255.

In an exemplary embodiment, the unresolved weapon firing events and unresolved scoring events may be arbitrarily resolved (i.e. arbitrary matched). Weapon firing events may be arbitrarily matched to scoring events in a variety of situations. For example, where accuracy is a concern and there are two unresolved weapon firing events (weapon firing events A and B) and two unresolved scoring events (scoring events A and B), weapon firing event A may be arbitrarily matched to scoring event B and weapon firing event B may be arbitrarily matched to scoring event A. In an exemplary embodiment where accuracy is a concern and there are two unresolved weapon firing events (weapon firing events A and B) but only one unresolved scoring events (scoring events A), neither weapon firing event may be arbitrarily matched to scoring event A. However, if accuracy is not a concern, weapon firing event A may be arbitrarily matched to scoring event A.

In block 255, the process may identify any remaining weapon firing events which are not within the time window and angular window associated with any scoring event (i.e. not even an unresolved ambiguous pairings). These weapon firing events may be marked as a "No Score" shots in the shooter record. From 255, flow diagram 200 may continue with 260.

In block 260, the process may end.

Figure 3:
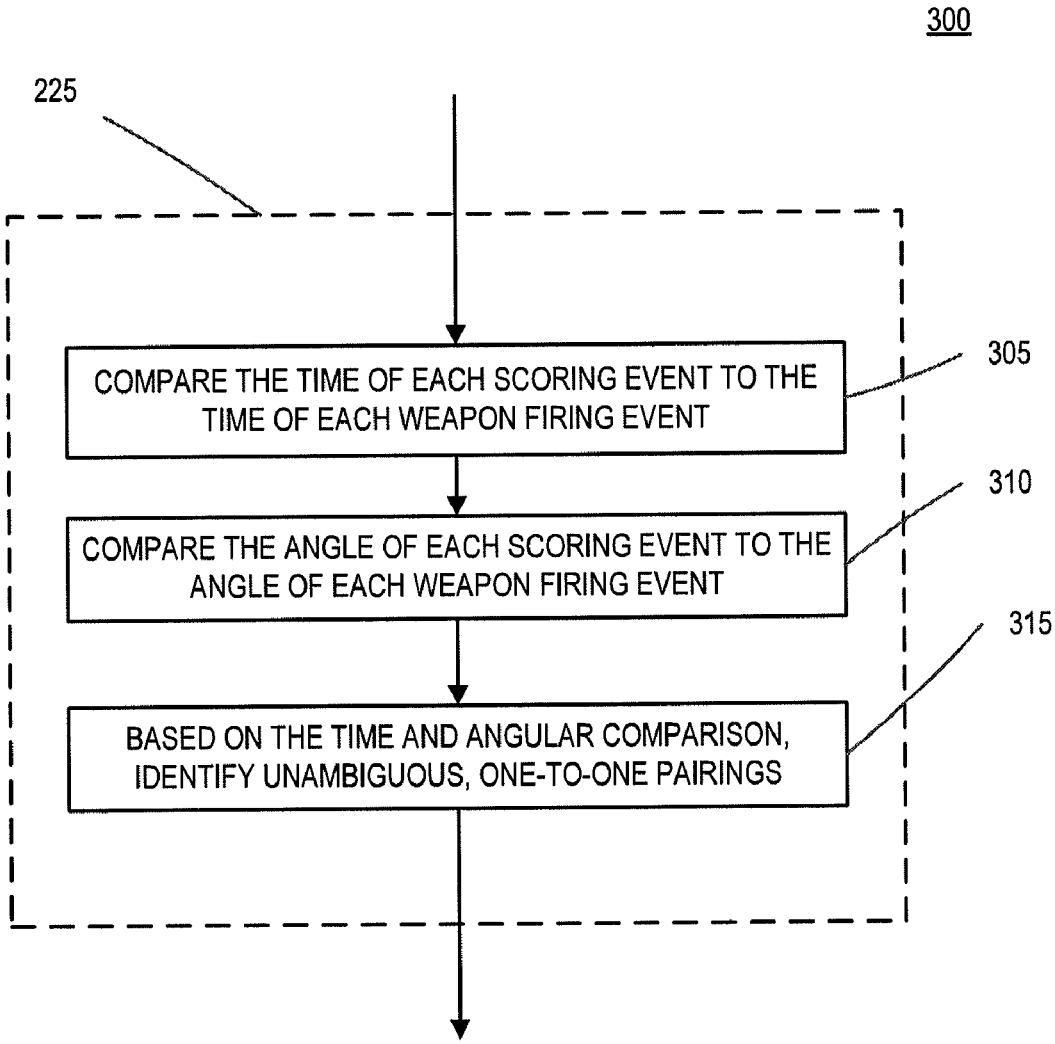
FIG. 3 depicts an exemplary method for correlating unambiguous one-to-one pairings among scoring events and weapon firing events.

FIG. 3 depicts an exemplary method 300 by which an exemplary embodiment of block 225 of flow diagram 200 may correlate unambiguous one-to-one pairings among scoring events and weapon firing events.

In block 305 of FIG. 3, the time of each scoring event may be compared to the time of each weapon firing event. If, for example, an exemplary weapon firing event occurred within a given time window of an exemplary scoring event, the exemplary weapon firing event and the exemplary scoring event may match.

A time window may refer to a period of time in which the exemplary projectile, which caused the exemplary weapon firing event, may have caused the exemplary scoring event. For example, a time window may refer to, e.g., but is not limited to, the exemplary time-of-flight (TOF) of the projectile plus or minus any potential variation in the exemplary projectile's TOF.

In an exemplary embodiment, the time window is added to the time of the exemplary weapon firing event to produce an adjusted weapon firing event time. The adjusted weapon firing event time is then compared to the time of the exemplary scoring event. If the adjusted time of the exemplary weapon firing event occurred at the same time as the exemplary scoring event, accounting for the potential variations in the exemplary TOF of the projectile, the exemplary weapon firing event and the exemplary scoring event may match.

TOF may refer to the time a projectile may take to reach the scoring area 101 from where it was fired (i.e. the weapon firing event location). TOF may be based on a particular projectile's known muzzle velocity, bullet aerodynamics, and the ambient temperature as well as the distance between the weapon event and the scoring area 101.

Potential variations in the TOF of the projectile may depend on the muzzle velocity variations among a particular type of ammunition and/or the accuracy of the location determinations of the weapon firing event and the scoring event. Variations in muzzle velocity for an exemplary type of ammunition may be known and/or controlled by, for example, a government entity, to be within an acceptable range, for example 40 ft/sec.

The accuracy of the location determinations of the weapon firing event and the scoring event depends on the accuracy of the location determination means, which are discussed in the cross referenced applications noted above. If, for example, the distance between a weapon firing event and a potential scoring event is calculated to be 300 feet, but the weapon firing event location determination is accurate to within +/−25 feet and the scoring event location determination is accurate to within +/−5 feet, the time window may be large enough to encompass the TOF of a projectile over a distance which is within +/−30 feet of the calculated distance between the weapon firing event and the potential scoring event (i.e. 300 feet +/−30 feet). From 305, flow diagram 300 may continue with 310.

In block 310 of FIG. 3, the angle of incidence with respect to a reference direction for each scoring event may be compared to a position-calculated angle of incidence for each weapon firing event under consideration. The position-calculated angle of incidence may refer to the angle between a line connecting the location of the scoring area 101 to the location of each weapon firing event and the reference direction. If, for example, the position-calculated angle of incidence for an exemplary weapon firing event is within a given angular window for the angle of incidence of an exemplary scoring event, the exemplary scoring event and the exemplary weapon firing event may match.

In an exemplary embodiment, the TIU 108 may determine the angle of incidence for the scoring event with the scoring area 101. An exemplary TIU 108 is described in cross referenced applications noted above. In addition, the TIU 108 may also determine the direction of the reference direction.

In an exemplary embodiment, the computer 110 may calculate the position-calculated angle of incidence for each weapon firing event under consideration. The computer 110 may calculate the position-calculated angle by, for example, receiving the position of an exemplary weapon associated with an exemplary weapon firing event, from player packs 112A or 112B, and the position of the scoring area 101 associated with an exemplary scoring event, from TIU 108, when the firing event under consideration occurred. The computer 110 may also receive the reference direction from TIU 108. The position-calculated angle may also be determined via a reference point instead of the location of the scoring area 101. The reference point may be, for example, but not limited to, a location of the projectile as it passed through the scoring area 101 (such as the location of the projectile as it first enters the scoring area 101, exits the scoring area 101, or as mid-way through the scoring area 101) or the center of scoring area 101.

In an exemplary embodiment, once the position of the exemplary weapon, the position of the exemplary scoring area 101, and the reference direction are received, the computer 110 may "draw" a reference line between the weapon position and the scoring area 101 position. The computer 110 may then determine the angle created by the reference line and the reference direction. An exemplary process by which a position-calculated angle may be determined is discussed further below with reference to FIGS. 6A and 6B.

Returning to block 310 of FIG. 2, an angular window may refer to a range of position-calculated angles within which an exemplary projectile, which may have caused an exemplary scoring event, may have originated. The angular window may, for example, refer to the position-calculated angle of incidence plus or minus any potential variations in the position-calculated angle of incidence and/or the angle of incidence for the scoring event with the scoring area 101, with respect to the reference direction.

Potential variations in the position-calculated angle of incidence between the scoring area 101 and the weapon may be caused by, for example, but not limited to, the accuracy of the location determination of the scoring area 101 (such as, for example, the center of the scoring area 101) and the weapon location where the weapon firing event being considered occurred. The angular window, therefore, may be large enough to encompass all potential position-calculated angles. For example, if the weapon firing event location determination is accurate to within +/−25 feet and the scoring event location determination is accurate to within +/−5 feet, the angular window may be large enough to encompass a position-calculated angle of incidence caused by a projectile fired within +/−30 feet of the weapon firing event location determination at a scoring area 101 within +/−5 feet of the scoring event location determination.

In an exemplary embodiment, the location determination accuracy may impact the size of an angular window for an exemplary scoring event and an exemplary weapon firing event. Continuing with the example above, an angular window for an exemplary weapon firing event and an exemplary scoring event separated by 50 feet +/−30 feet may be considerably larger than an angular window for an exemplary weapon firing event and an exemplary scoring event separated by 300 feet +/−25 feet. The applicable angular window, therefore, maybe inverse to the distance between the weapon firing event and the scoring event. In an exemplary embodiment, the accuracy of the location determination of the scoring event when the scoring event occurred may depend on whether the scoring area 101 is moving or stationary. The location of a stationary scoring area 101 may be averaged over time and, therefore, be fairly accurate. The location of a moving scoring area 101 may be averaged over a smaller amount of time and, therefore, be less accurate. These same principles apply to the weapon firing event location determination. The accuracy of the location determination of the weapon firing event may depend on how fast the player pack 112A or 112B moves.

Potential variations in the angle of incidence for the scoring event with the scoring area 101, with respect to the reference direction may be due to, for example, but not limited to, improper setup of the TIU 108 and/or a known accuracy range of the TIU 108. For example, an exemplary TIU 108 may be able to calculate the angle of incidence of the scoring event within the scoring area 101 and the reference direction to within +/−3 degrees. From 310, flow diagram 300 may continue with 315.

In block 315, based on the time comparison and the angle comparison, the computer 110 may identify unambiguous, one-to-one pairings between scoring events and weapon firing events. For example, where only a single exemplary scoring event that is within both a given time window and a given angular window of an exemplary weapon firing event, there may be an unambiguous, one-to-one pairing between the single scoring event and the weapon firing event and may be removed from further consideration. However if, for example, an exemplary weapon firing is within the time and angular window for two exemplary scoring events, the weapon firing event and the two scoring events may be considered an ambiguous and not removed from further consideration. From 315, flow diagram 300 may continue with block 230 of FIG. 2.

Figure 4A:
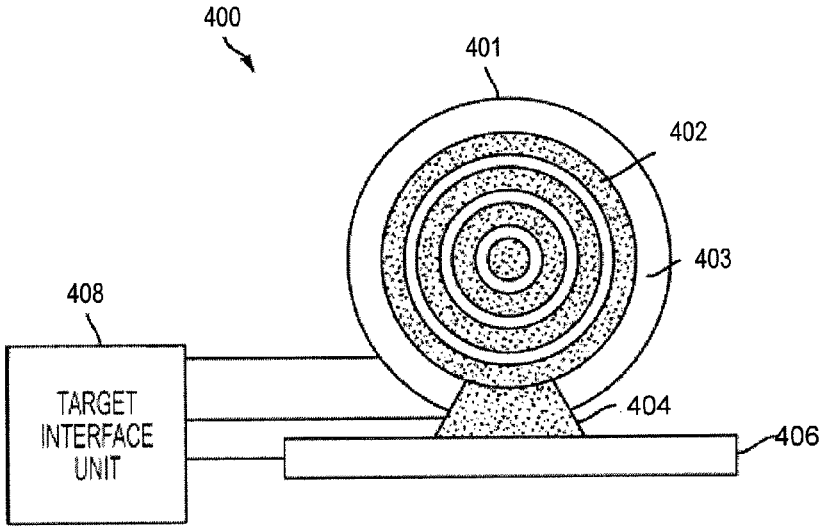
FIGS. 4A and 4B depict an exemplary process by which a position-calculated angle may be determined.
Figure 4B:
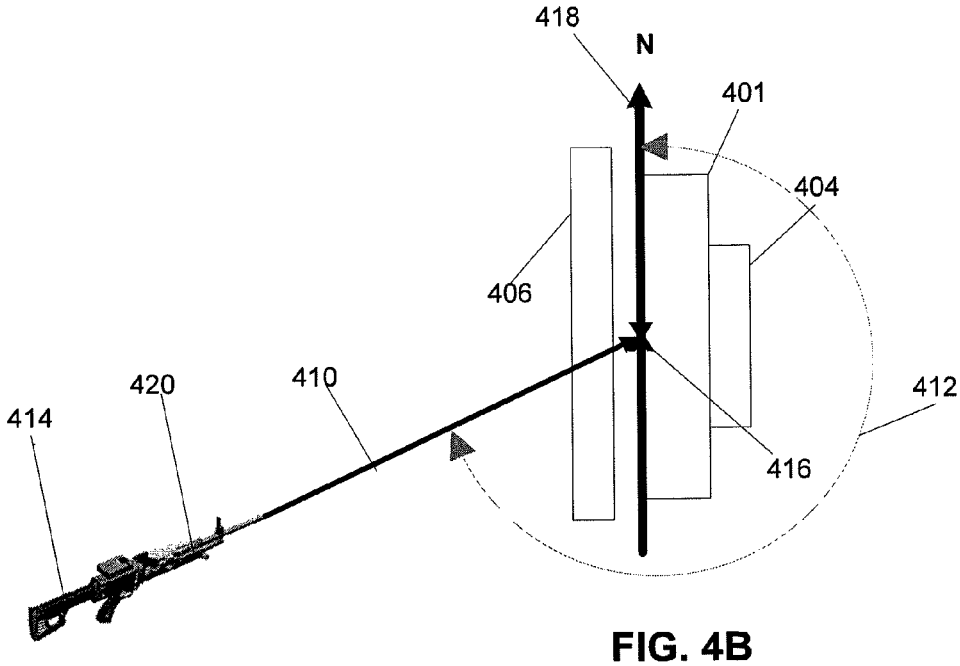

FIGS. 4A and 4B depict an exemplary process by which a position-calculated angle may be determined. FIG. 4A depicts front view of an exemplary TIU 400 including the scoring area 401 which is attached to a lifter 404 as well as a target 402 and a suppression zone 403. A sensor 406 may be located in front of scoring area 401. The scoring area 401, lifter 404, and sensor 406 may be coupled electrically, wired, wirelessly, physically and/or mechanically, including via a communications link (directly, or indirectly) to the TIU 408

FIG. 4B depicts a top view of exemplary scoring area 401, lifter 404, sensor 406, and TIU 408. FIG. 4B also shows the reference plane 418 (e.g. true north) as well as the position 420 of an exemplary weapon 414 associated with an exemplary weapon firing event and the position 416 (represented by, for example, but not limited to the center of the scoring area 401) of the scoring area 401.

In an exemplary embodiment, the computer 110 may "draw" a reference line 410 between the weapon position 420 and the scoring area 401 position 416. The computer may then determine the position-calculated angle 412 created by the reference line 410 and the reference plane 418 to be 235 degree from true north.

Figure 5:
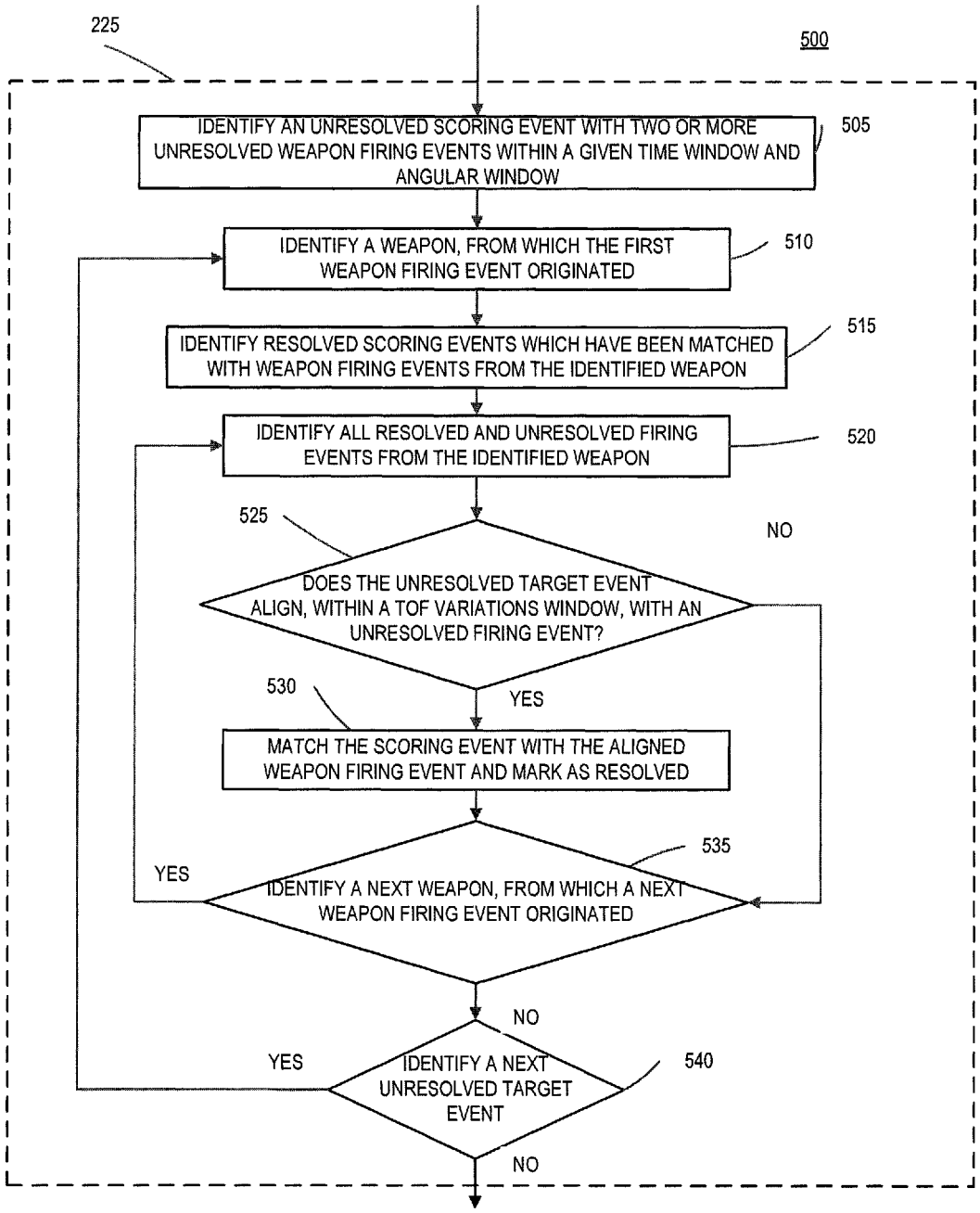
FIG. 5 depicts an exemplary method for correlating unambiguous, one-to-one pairings among remaining scoring events and weapon firing events from individual weapons.

FIG. 5 depicts an exemplary method 500 by which an exemplary embodiment of block 235 may correlate unambiguous, one-to-one pairings among remaining scoring events and weapon firing events from individual weapons.

In an exemplary embodiment, block 235 may be used to identify burst shots. Burst shots may be, for example, two or more shots fired at the same target 102, by the same weapon, within a short period of time. Block 235 may also be used to identify two or more shots fired by the same weapon within several milliseconds to approximately 0.5 from one another. Thus, block 235 may assume the location of the weapon has not changed significantly between shots. Since the location between the two or more shots is substantially the same, location determination accuracy no longer impacts the TOF variations for the projectile and, therefore, the time window may be decreased.

In block 505, the computer 110 may identify an unresolved scoring event which has two or more unresolved weapon firing events within the time window and angular window associated with the unresolved scoring event. The two or more weapon firing events may originate from one or more weapons 114A, 114B. From 505, flow diagram 500 may continue with 510.

In block 510, the computer 110 may identify a weapon 114A, 114B, from which the first weapon firing event originated, within the applicable time and angular window. From 510, flow diagram 500 may continue with 515.

In block 515, the computer 110 may identify all resolved scoring events which have been matched with weapon firing events from the identified weapon 114A, 114B. The computer 110 may also identify a subset of all the relevant, resolved scoring events from a period of time before/after the unresolved scoring event (such as, e.g., but not limited to, +/−1 second, a ½ second, or 1/10 of a second from the unresolved scoring event). Once the relevant, resolved scoring events are identified, the relevant, resolved scoring events, along with the first unresolved scoring event, may be arranged chronologically and the time between the events may be calculated. From 515, flow diagram 500 may continue from 520.

In block 520, the computer 110 may identify all resolved and unresolved firing events from the identified weapon. The computer 110 may also take a subset of the resolved and unresolved firing events from the identified weapon that are within a period of time before/after the unresolved scoring event (such as, e.g., but not limited to, +/−1 second, a ½ second, or 1/10 of a second from the unresolved scoring event). These firing events may then be arranged chronologically and the time between the firing events calculated. From 520, flow diagram 500 may continue from 525.

In block 525, the computer 110 may compare the temporal spacing of the scoring events identified in block 520 with the firing events of 515. If the unresolved scoring event aligns, with TOF variations window, with an unresolved firing event from the identified weapon and no other firing events are within that window, the computer 110 proceeds to block 530, if the two events do not align, the process continues to block 535.

In block 530, the two events are matched and marked as resolved. In an exemplary embodiment, the first weapon event of block 510 and the unresolved firing event of block 520 may be burst shots from the same weapon. The process may then continue to 535.

In block 535, the process may identify a next weapon, from which a next firing event originated, within the applicable time and angular window, and proceed to block 520. Thus, blocks 520 through 530 may be repeated for each weapon firing event which originated within the applicable time and angular window of the scoring event until a match is found or no more weapon firing events are available. If a next weapon is not identified, the process may continue to block 540.

In block 540, the computer 110 may identify a next unresolved scoring event which may have a group of two or more unresolved weapon firing events within its time window and angular window and may proceed to block 510. Thus, blocks 510-530 may be repeated for all remaining unresolved scoring events which have a group of two or more unresolved weapon firing events within its time window and angular window. Once all of the unresolved scoring events have been addressed, the process may continue to block 240 of FIG. 2.

Figure 6:
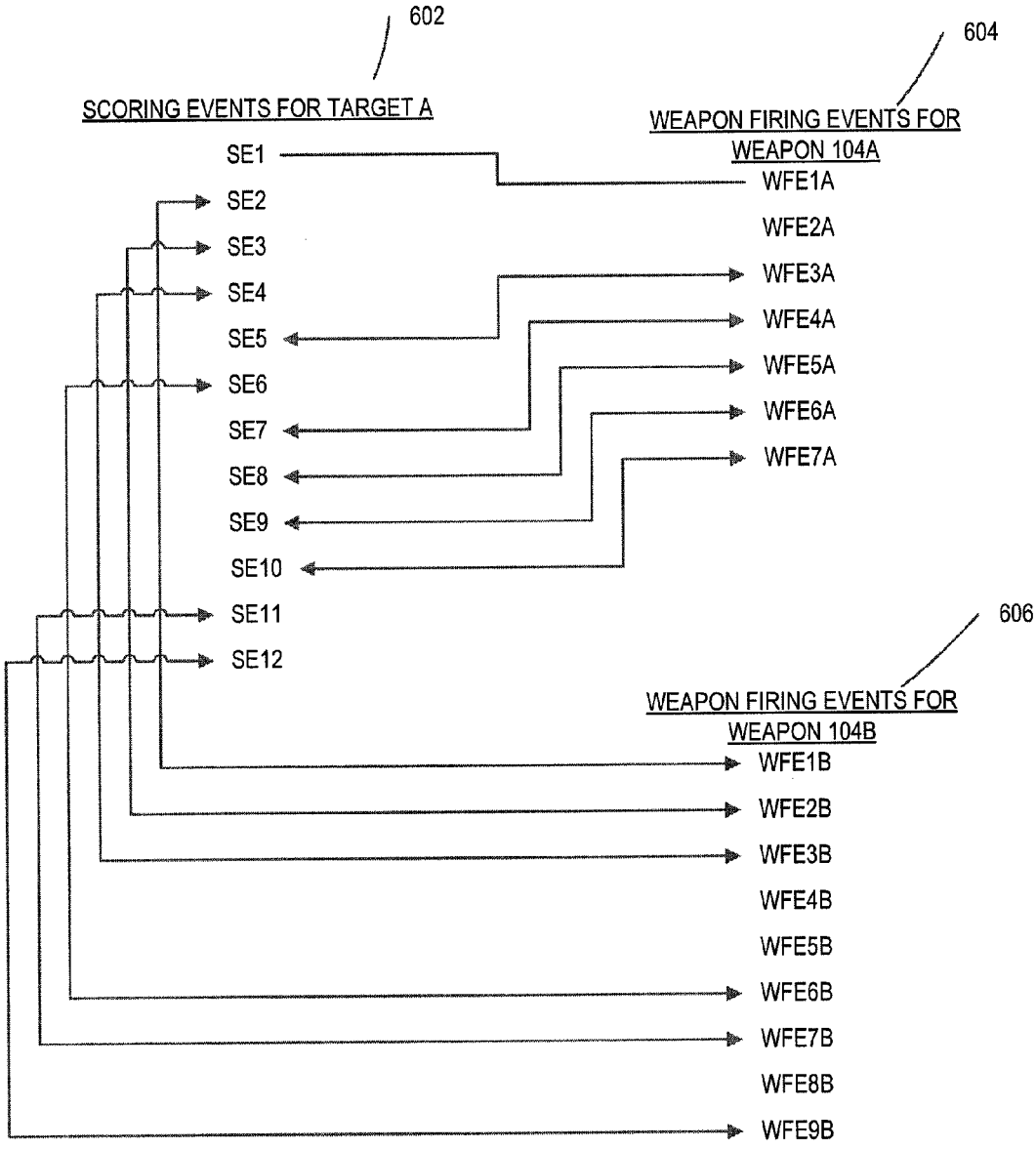
FIG. 6 illustrates an exemplary method for correlating weapon firing events, from multiple weapons, with scoring events.

FIG. 6 illustrates an exemplary process by which weapon firing events from multiple weapons may be correlated with multiple scoring events. FIG. 6 will be described in connection with FIGS. 1-5.

In block 210 of flow diagram 200 of FIG. 2, the computer 110 may receive exercise parameters. These parameters may include one or of the parameters discussed in block 210 of FIG. 2. From block 210, the flow diagram 200 may continue to block 215.

In block 215, the computer 110 may access and organize scoring event data 602. See block 215 of FIG. 2. The scoring event data 602 may comprise eleven scoring events SE1-SE11 gathered from a TIU 108, of FIG. 1, which is coupled to target 102. From block 215, flow diagram 200 may continue to block 220.

In block 220 of FIG. 2, the computer 110 may then access and organize weapon firing event data 604, 606 from weapon 112A and 112B of FIG. 1. Weapon firing event data from weapon 112A 604 may be comprised of seven weapon firing events WFE1A-WFE7A. Weapon firing event data 606 from weapon 112B may be comprised of eight weapon firing events WFE1B-WFE9B. From block 220, the flow diagram 200 may continue to block 225.

In block 225 of FIG. 2, the computer 110 may compare scoring events SE1-SE11 and weapon firing events WFE1A-WFE7A and WFE1B-WFE9B in order to identify unambiguous matches based on a given time and angular window. For example, the computer 110 may identify the following unambiguous matches based on a first time and first angular window: SE1 and WFE1A; SE2 and WFE1B; SE4 and WFE3B; and SE8 and WFE5A. From block 225, the flow diagram 200 may continue to block 230.

In block 230 of FIG. 2, the computer 110 may then compare the remaining scoring events SE3, SE5-SE7, and SE9-SE11 and the remaining weapon firing events WFE2A-WFE4A, WFE6A, WFE7A, WFE2B, and WFE4B-WFE9B in order to identify additional unambiguous matches based on the first time and the first angular window. See block 230 in FIG. 2. For example, the computer 110 may identify the following unambiguous matches based on the first time and the first angular window: SE3 and WFE2B; and SE11 and WFE7B. From block 230, the flow diagram 200 may continue to 235.

In block 235 of FIG. 2, the computer may correlate unambiguous, one-to-one pairings among remaining scoring events and weapon firing events from individual weapons according to blocks 505-540 of flow diagram 500 of FIG. 5.

In block 505 of FIG. 5, the computer may identify unresolved scoring event SE9 with two or more unresolved weapon firing events WFE6A and WFE7A within a given time window and angular window. From block 505, the flow diagram 500 may continue to 510.

In block 510, the computer 110 may identify weapon 112A as being associated with SE9. From block 510, the flow diagram 500 may continue to 515.

In block 515, the computer may identify resolved scoring events SE8, which has been matched to weapon firing events WFE5A from weapon 112A, as the only resolved scoring event within a period of time before/after the unresolved scoring event SE9. The computer 110 may also calculate the time between the unresolved scoring event SE9 and the resolved scoring event SE8. From block 515, the flow diagram 500 may continue to 520.

In block 520, the computer 110 may identify WFE4A-WFE7A as all of the resolved and unresolved weapon firing events from weapon 112A that are within a period of time of unresolved scoring event SE9. The computer 110 may also calculate the time between each weapon firing event. From block 520, the flow diagram 500 may continue to 520.

In block 525, the computer 110 may compare the resolved scoring event SE8 as well as unresolved scoring event SE9 to the resolved and unresolved weapon firing events WFE4A-WFE7A. Based on the temporal spacing of scoring events SE8, and SE9 with firing events WFE4A-WFE7A, the computer 110 may determine that SE9 unambiguously matches WFE6A. SE9 and WFE6A may be matched in block 530 and the flow diagram 500 may continue to 535.

In block 535, computer 110 may repeat blocks 520-530 and unambiguously match SE10 with WFE7A. From block 535, the flow diagram 500 may continue to 535.

In block 540, computer 110 may repeat blocks 505-535 in an attempt to resolve unresolved scoring events SE5-SE7. For example, the computer 110 may be unable to make any additional correlations. From block 540, the flow diagram 500 may continue to block 240 of flow diagram 200 in FIG. 2.

In block 240, the computer 110 may attempt to correlate the remaining unresolved scoring events SE5-SE7 and SE12 with the remaining unresolved weapon firing events WFE2A-WFE4A, WFE4B-WFE6B, WFE8B, and WFE9B and identify additional unambiguous, one-to-one pairings, similar to block 225 above. For example, the computer 110 may determine that SE12 and WFE9B unambiguously match based on the first time and the first angular window. From block 240, the flow diagram 200 may continue to 245.

In block 245, the computer 110 may associate a second time window and a second angular window with SE5, which are both smaller than the first time window and the first angular window, and successfully correlate and mark as resolved SE 6 and WFE3A as an unambiguous resolved pair the same manner. From block 245, the flow diagram 200 may continue to 250.

In block 250, the process may identify unresolved weapon firing events WFE6B and WFE4A, which are within the second time window and the second angular window associated with unresolved scoring events SE6 and SE7. SE6 and WFE6B as well as SE7 and WFE4A may then be arbitrarily resolved and/or recorded separately. From block 250, the flow diagram 200 may continue to 255.

In block 255, the process may identify and mark each remaining weapon firing events WFE2A, WFE4B, WFE5B, and WFE8B, which are not within the time window and angular window associated with any scoring event (i.e. not even an unresolved ambiguous pairing) as a "No Score" in the weapon firing event data 604, 606. From block 255, the flow diagram 200 may continue to block 260 where it may end.

In addition to those factors discussed above, the accuracy of the exemplary method of correlating weapon firing events, from multiple weapons, with scoring events may be impacted on additional factors.

The accuracy of the exemplary method may be impacted by the number of near coincident shots from shooters at nearly the some position and at the same scoring area 101. The probability of coincident shots is highest when multiple shooters are firing automatic weapons at a single scoring area 101.

Figure 7:
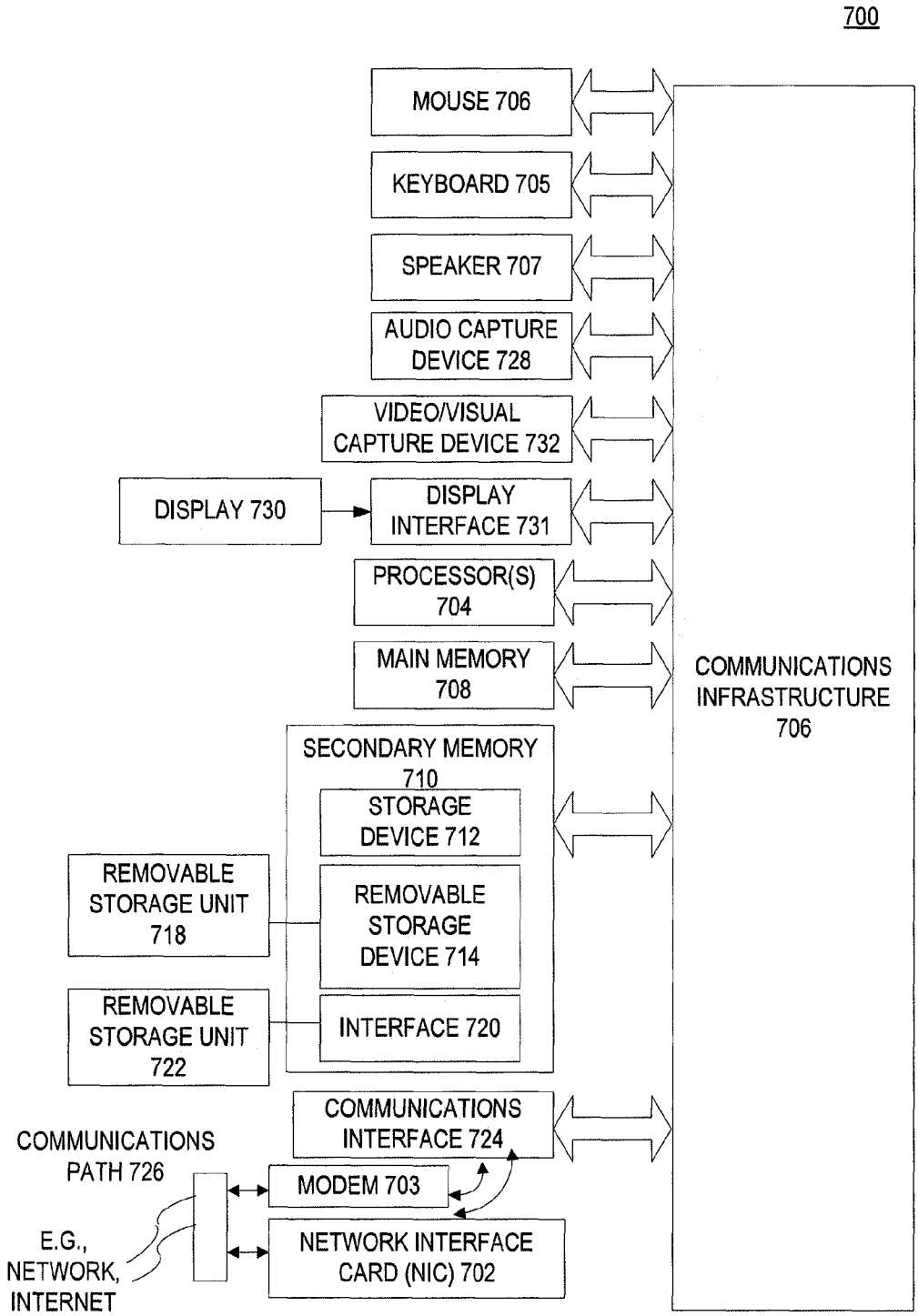
FIG. 7 depicts diagram 700 illustrating an exemplary computer system.

FIG. 7 depicts diagram illustrating an exemplary computer system 700 such as may be used in, or in combination with devices 101-104, 106, 108, 110, 112A, 112B, 114A, and 114B, etc. and that may be used in implementing an exemplary embodiment of the present invention. Specifically, FIG. 7 depicts an exemplary embodiment of a computer system 700 that may be used in computing devices such as, e.g., but not limited to, a client and/or a server, etc., according to an exemplary embodiment of the present invention. The present invention (or any part(s) or function(s) thereof) may be implemented using hardware, software, firmware, and/or a combination thereof and may be implemented in one or more computer systems 700 or other processing systems. In fact, in one exemplary embodiment, the invention may be directed toward one or more computer systems capable of carrying out the functionality described herein. An example of a computer system 700 is shown in FIG. 7, depicting an exemplary embodiment of a block diagram of an exemplary computer system 700 useful for implementing the present invention. Specifically, FIG. 7 illustrates an example computer 700, which in an exemplary embodiment may be, e.g., but not limited to, a personal computer (PC) system running an operating system such as, e.g., (but not limited to) MICROSOFT® WINDOWS® NT/98/2000/XP/CE/ME/VISTA/etc. available from MICROSOFT® Corporation of Redmond, Wash., U.S.A. However, the invention may not be limited to these platforms. Instead, the invention may be implemented on any appropriate computer system running any appropriate operating system such as, e.g., but not limited to, an Apple computer executing MAC OS. In one exemplary embodiment, the present invention may be implemented on a computer system operating as discussed herein. An exemplary computer system, computer 700 is shown in FIG. 7. Other exemplary computer systems may include additional components, such as, e.g., but not limited to, a computing device, a communications device, mobile phone, a telephony device, an iPhone (available from Apple of Cupertino, Calif. USA), a 3G wireless device, a wireless device, a telephone, a personal digital assistant (PDA), a personal computer (PC), a handheld device, a portable device, an interactive television device (iTV), a digital video recorder (DVD), client workstations, thin clients, thick clients, fat clients, proxy servers, network communication servers, remote access devices, client computers, server computers, peer-to-peer devices, routers, gateways, web servers, data, media, audio, video, telephony or streaming technology servers, game consoles, content delivery systems, etc., may also be implemented using a computer such as that shown in FIG. 7. In an exemplary embodiment, services may be provided on demand using, e.g., but not limited to, an interactive television device (iTV), a video on demand system (VOD), via a digital video recorder (DVR), and/or other on demand viewing system.

The computer system 700 may include one or more processors, such as, e.g., but not limited to, processor(s) 704. The processor(s) 704 may be coupled to and/or connected to a communication infrastructure 706 (e.g., but not limited to, a communications bus, cross-over bar, or network, etc.). Various exemplary embodiments may be described in terms of this exemplary computer system 700. After reading this description, it may become apparent to a person skilled in the relevant art(s) how to implement the invention using other computer systems and/or architectures.

Computer system 700 may include a display interface 731 that may forward, e.g., but not limited to, graphics, text, and other data, etc., from the communication infrastructure 706 (or from a frame buffer, etc., not shown) for display on the display unit 730.

The computer system 700 may also include, e.g., but may not be limited to, a main memory 708, random access memory (RAM), and a secondary memory 710, etc. The secondary memory 710 may include a computer readable medium such as, for example, (but not limited to) a hard disk drive 712 and/or a removable storage drive 714, representing a floppy diskette drive, a magnetic tape drive, an optical disk drive, magneto-optical, a compact disk drive CD-ROM, etc. The removable storage drive 714 may, e.g., but not limited to, read from and/or write to a removable storage unit 718 in a well known manner. Removable storage unit 718, also called a program storage device or a computer program product, may represent, e.g., but not limited to, a floppy disk, magnetic tape, optical disk, compact disk, etc. which may be read from and written to by removable storage drive 714. As may be appreciated, the removable storage unit 718 may include a computer usable storage medium having stored therein computer software and/or data. In some embodiments, a "machine-accessible medium" may refer to any storage device used for storing data accessible by a computer. Examples of a machine-accessible medium may include, e.g., but not limited to: a magnetic hard disk; a floppy disk; an optical disk, like a compact disk read-only memory (CD-ROM), flash memory, non-volatile memory, or a digital versatile disk (DVD); digital video recorder disk (DVR); a magnetic tape; and a memory chip, etc.

In alternative exemplary embodiments, secondary memory 710 may include other similar devices for allowing computer programs or other instructions to be loaded into computer system 700. Such devices may include, for example, a removable storage unit 722 and an interface 720. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units 722 and interfaces 720, which may allow software and data to be transferred from the removable storage unit 722 to computer system 700.

Computer 700 may also include an input device such as, e.g., (but not limited to) a mouse 706 or other pointing device such as a digitizer, an audio capture device 728 (such as, e.g., but not limited to, a microphone), an image video/visual capture device 732 (such as, e.g., but not limited to, a camera), and a keyboard 705 and/or other data entry device (not shown), etc.

Computer 700 may also include output devices, such as, e.g., (but not limited to) display 730, display interface 731, and/or a speaker 707, etc. Other output devices may also be used, including, e.g., but not limited to, a printer, etc. Computer 700 may include input/output (I/O) devices such as, e.g., (but not limited to) communications interface 724 and communications path 726, etc. These devices may include, e.g., but not limited to, a network interface card 702, and modem(s) 703. Communications interface 724 may allow software and data to be transferred between computer system 700 and external devices.

In this document, the terms "computer program medium" and "computer readable medium" may be used to generally refer to media such as, e.g., but not limited to removable storage drive 714, a hard disk installed in hard disk drive 712, a storage area network (SAN), database, etc. These computer program products may provide software to computer system 700. The invention may be directed to such computer program products. In some cases, a computer program product may include software which may be distributed via a communication system and then may be stored on a storage device.

The accuracy of the exemplary method may also be impacted by the accuracy and reliability of the weapon firing event location determinations and scoring event location determinations. Accuracy and reliability concerns may be addressed by improving the accuracy and reliability of these measurements and/or adjusting the time window or angular window to account for such concerns.

What is claimed is:

1. A method for correlating at least one weapon firing event to at least one scoring event comprising:

(a) receiving at a first computing device, for a first scoring event at a target, a time at which the first scoring event occurred, a location of the target when the scoring event occurred, a direction of a reference direction associated with the target, and an angle of incidence for a projectile associated with the scoring event at the target with respect to the reference direction;

(b) receiving at the first computing device, for a first weapon firing event, a time a which the first weapon firing event occurred, and a location where the first weapon firing event occurred;

(c) calculating at the first computing device an angle between a reference line extending the from location of the first weapon event to the location of the first scoring event, and the reference direction;

(d) comparing at the first computing device the time of the first scoring event to the time of the weapon firing event to obtain a first comparison result;

(e) comparing at the first computing device the angle of incidence for the projectile to the calculated angle to obtain a second comparison result; and (f) identifying at the first computing device, based on the first and second comparison results, whether the weapon firing event and the scoring event are an unambiguous, one-to-one pairings.

2. The method of claim 1, wherein (c) further comprises:

calculating a time-of-flight window for a projectile associated with the first weapon firing event; and adding the calculated time-of-flight window to the time of the first weapon firing; and wherein (d) further comprises:

comparing at the first computing device the time of the first scoring event to the time of the weapon firing event.

3. The method of claim 1, wherein the time at which each scoring event occurred and the time at which each weapon firing event occurred are determined in relation to a common source of time.

4. A method for correlating weapon firing events to target scoring events comprising:

(a) receiving at a first computing device, for a plurality of scoring events, a time at which each scoring event occurred, a location of each scoring area when each scoring event occurred, a direction of a reference direction associated with each scoring area, and an angle of incidence for each projectile associate with each scoring event with respect to the reference direction;

(b) receiving at the first computing device, for a plurality of weapon firing events, a time at which the each weapon firing event occurred, and a location where each weapon firing events occurred;

(c) creating a plurality of reference lines for each scoring event and each weapon firing event combination, wherein each reference line extends from the location of each weapon firing event to the location of each scoring area for each scoring event;

(d) calculating at the first computing device a plurality of angles between the plurality of reference lines and the reference direction;

(e) comparing at the first computing device the time of each scoring event to the time of each weapon firing event to obtain a first comparison result;

(f) comparing at the first computing device the angle of incidence for the projectile of each scoring event to each of the calculated angles to obtain a second comparison result;

(g) identifying at the first computing device, based on the first and second comparison results, each unambiguous, one-to-one pairings between scoring events and weapon firing events; and (h) storing each unambiguous, one-to-one pairing identified in step (g).

5. The method of claim 4, further comprising:

(i) removing each unambiguous, one-to-one pairing identified in (g) from further consideration;

(j) comparing at the first computing device the time of each remaining scoring event to the time of each remaining weapon firing event to obtain a third comparison result;

(k) comparing at the first computing device the angle of incidence of the projectile of each remaining scoring event to each of the calculated angles to obtain a fourth comparison result; and (l) identifying at the first computing device, based on the third and fourth comparison results, unambiguous, one-to-one pairings between scoring events and weapon firing events.

6. The method of claim 4, wherein (c) further comprises:

calculating a time-of-flight window for a projectile associated with each weapon firing event; and adding each calculated time-of-flight window to the time of each weapon firing; and wherein (d) further comprises:

comparing the time of each scoring event to the time of each weapon firing event at the first computing device.

7. The method of claim 4, wherein the time at which each scoring event occurred and the time at which each weapon firing event occurred are determined in relation to a common measurement of time.

8. The system for correlating weapon firing events to target scoring events comprising:

(a) a computing device;

(b) a target device for detecting a plurality of scoring events and, for each detected scoring event, determining a time at which each scoring event occurred, a location of each scoring area when each scoring event occurred, a direction of a reference direction, an angle of incidence for each projectile associate with each scoring event with respect to the reference direction, and outputting said determinations to the computing device; and (c) a weapon device for detecting a plurality of weapon firing events and, for each detected weapon firing event, determining a time at which the each weapon firing event occurred, a location where each weapon firing event occurred, and outputting said determinations to the computing device, (i) wherein said computing device:

1. creates a plurality of reference lines for each scoring event and each weapon firing event combination, wherein each reference line extends from the location of each weapon firing event to the location of each scoring event;
2. calculates a plurality of angles between the plurality of reference lines and the reference direction;
3. compares the time of each scoring event to the time of each weapon firing event at the first computing device to obtain first comparison results;
4. compares the angle of incidence of the projectile of each scoring event to each of the calculated angles to obtain a second comparison results;
5. identifies, based on the first and second comparison results, each unambiguous, one-to-one pairings between scoring events and weapon firing events; and
6. stores each unambiguous, one-to-one pairing identified in step 5.

* * * * *